US008293336B2

(12) United States Patent
Craamer et al.

(10) Patent No.: US 8,293,336 B2
(45) Date of Patent: Oct. 23, 2012

(54) METHOD OF PRODUCING A TEXTILE ARTICLE HAVING A FUNCTIONAL FINISH

(75) Inventors: Johannes Antonius Craamer, Ijlst (NL); James E. Fox, Cambridge (GB); Gerhard H. Bouwhuis, Losser (NL); Alfons M.F. Wegdam, Delden (NL)

(73) Assignee: Ten Cate Advanced Textiles B.V., Nijeverdal (NL)

( * ) Notice: Subject to any disclaimer, the term of this patent is extended or adjusted under 35 U.S.C. 154(b) by 1202 days.

(21) Appl. No.: 11/886,716

(22) PCT Filed: Mar. 22, 2006

(86) PCT No.: PCT/EP2006/060963

§ 371 (c)(1),
(2), (4) Date: Sep. 20, 2007

(87) PCT Pub. No.: WO2006/100272

PCT Pub. Date: Sep. 28, 2006

(65) Prior Publication Data

US 2009/0162621 A1 Jun. 25, 2009

(30) Foreign Application Priority Data

Mar. 22, 2005 (GB) ..... 0505874.8

(51) Int. Cl.
*B05D 1/32* (2006.01)

(52) U.S. Cl. ..... 427/466; 427/256; 427/265; 427/288; 427/389.9; 427/394

(58) Field of Classification Search ..... 427/288, 427/256, 265, 466, 389.9, 393.1, 393.2, 393.3, 427/393.4, 394

See application file for complete search history.

(56) References Cited

U.S. PATENT DOCUMENTS

| | | | | |
|---|---|---|---|---|
| 3,717,722 | A | 2/1973 | Messner | |
| 3,785,179 | A | 1/1974 | Davis et al. | |
| 4,170,883 | A | 10/1979 | Varner | |
| 4,546,624 | A | 10/1985 | Von der Eltz et al. | |
| 4,650,694 | A | 3/1987 | Dressler et al. | |
| 5,512,930 | A * | 4/1996 | Brandt et al. | 347/212 |
| 2001/0051217 | A1 * | 12/2001 | Nigam | 427/256 |
| 2003/0081094 | A1 | 5/2003 | Van Veen et al. | |
| 2003/0203114 | A1 * | 10/2003 | Nash et al. | 427/256 |
| 2004/0130585 | A1 * | 7/2004 | Weksler et al. | 347/12 |
| 2006/0200267 | A1 * | 9/2006 | Aamodt et al. | 700/122 |
| 2007/0040879 | A1 | 2/2007 | Chung | |
| 2009/0293209 | A1 | 12/2009 | Chung | |

FOREIGN PATENT DOCUMENTS

| | | | |
|---|---|---|---|
| EP | 0693587 | A2 | 1/1996 |
| GB | 2187419 | A | 9/1987 |
| JP | 61152874 | A | 7/1986 |
| WO | 2005/028729 | A2 | 5/2005 |
| WO | 2005/028730 | A1 | 5/2005 |
| WO | 2005/028731 | A1 | 5/2005 |

* cited by examiner

*Primary Examiner* — Frederick Parker
*Assistant Examiner* — Xiao Zhao
(74) *Attorney, Agent, or Firm* — Coraline J. Haitjema; David P. Owen; Hoyng Monegier LLP

(57) ABSTRACT

A method of producing a textile article having a localized finish is described. The method comprises providing a continuous supply of a textile substrate, providing an array of digital nozzles, supplying a finishing composition to the nozzles and selectively depositing the finishing composition from the nozzles in a series of droplets to deposit a first predetermined pattern of droplets on a selected area of the substrate to endow a functional characteristic on the selected areas. In this way, it is possible to ensure that only those areas receive the finishing composition that ultimately require it. Usage of valuable chemicals and process time can hereby be reduced.

14 Claims, 2 Drawing Sheets

METHOD OF PRODUCING A TEXTILE ARTICLE HAVING A FUNCTIONAL FINISH

BACKGROUND OF THE INVENTION

1. Field of the Invention

The present invention relates to a process for upgrading a textile article. In particular, the invention relates to a digital procedure for producing a textile article having a localized finish applied to selected areas thereof and the textile article resulting therefrom.

2. Description of the Related Art

The production of textiles traditionally takes place in a number of distinct processes. Roughly five stages can be distinguished in such production; the fibre production; spinning of the fibres; the manufacture of cloth (for instance woven or knitted fabrics, tufted material or felt and non-woven materials); the upgrading of the cloth; and the production or manufacture of end products. Textile upgrading covers a number of operations such as preparing, bleaching, optically whitening, colouring (dyeing and/or printing) and finishing. These operations generally have the purpose of giving the textile the appearance and physical and functional characteristics that are desired by the user.

During dyeing, the textile substrate is usually provided with a single full plane colour. Dyeing presently takes place by immersing the textile article in a dye bath, whereby the textile is saturated with an appropriate coloured chemical substance. During both dyeing and printing the primary goal is to change the colour of the substrate. This is thus an aesthetic effect, characterized by the use of permanent inks or pigments, which have absorption properties between 400 and 700 nm.

The primary goal of finishing is to use auxiliary chemicals to change the physical and/or mechanical characteristics of the textile. These finishing techniques are meant to improve the properties of and/or add properties to the final product. A distinction will henceforth be made between colouring and finishing. Where necessary, finishing may be understood to exclude treatments involving the deposition of particles that are applied to the substrate only because of their absorption properties between 400 and 700 nm.

Coating of the textile is one of the more important techniques of finishing and may be used to impart various specific characteristics to the resulting product. It may be used for making the substrate fireproof or flameproof, water-repellent, oil repellent, non-creasing, shrink-proof, rot-proof, non-sliding, fold-retaining, antistatic etc. Coating of textile involves the application of e.g. a thin layer of an appropriate chemical substance to the surface of the textile substrate. The coating may serve to protect the textile substrate or other underlying layers. It may also be used as a basis or "primer" for subsequent layers or may be used to achieve desired special effects.

The usual techniques for applying a coating on solvent or water basis are the so-called "knife-over-roller", the "dip" and the "reverse roller" screen coaters. A solution, suspension or dispersion of a polymer substance in water is usually applied to the cloth and excess coating is then scraped off with a doctor knife.

A further procedure sometimes employed for finishing of the textile is the use of immersion or bath techniques such as foularding. The textile is fully immersed in an aqueous solution containing the functional composition that is to be applied. Subsequent repeated cycles of drying, fixation and condensation are required to complete the operation. This leads to considerable use of resources, in particular water and energy. In general, the solutions, suspensions or dispersions used for such techniques have low concentrations of the desired functional composition The conventional upgrading procedures require the performance of a number of sequential operations selected from impregnation (i.e. application or introduction of chemicals), reaction/fixing (i.e. binding chemicals to the substrate), washing (i.e. removing excess chemicals and auxiliary chemicals) and drying. Each of these sequential operations may need to be repeated a number of times e.g. repeated washing and rinsing cycles, which may entail a relatively high environmental impact, a long throughput time and relatively high production costs.

A significant characteristic of conventional upgrading techniques such as dyeing and finishing is that they are performed over the complete surface of the article. This is often referred to as full font treatment. For certain treatments, there may be a desire to finish only certain areas of the textile in order to provide particular characteristics to these areas. It is also often the case that treatments and chemicals used for finishing are particularly expensive. In such cases, the performance of the treatment over the full textile area may be inefficient and/or wasteful, especially if certain areas of the textile are to be discarded or have no need of the treatment.

A known method of dyeing and finishing is disclosed in U.S. Pat. No. 4,546,624. According to this known procedure, a textile article is immersed in an impregnating trough in a continuous process. A finishing composition exchange unit continuously applies the composition evenly over the width of the web by partly or completely replacing the moisture already present on the textile material by sucking or pressing a circulating impregnating composition through the web.

The use of digital techniques for finishing textiles has been suggested in unpublished PCT application Nos PCT/EP2004/010732 and PCT/EP2004/010731 both filed on 22 Sep. 2004 the contents of which are hereby incorporated by reference in their entirety.

It has been suggested in unexamined patent application No. JP61-152874 to Toray Industries, to impregnate a textile sheet with a functional composition in the form of dots. Various functional compositions are suggested including antibiotics, moisture absorbents, water repellents, antistatic agents, ultraviolet rays absorbents, infrared rays absorbents, optical whitening agents, swelling agents, solvents, saponifier, embrittlement agent, inorganic granules, metal granules, magnetic material, flame retardants, resistance, oxidants, reducing agents, perfumes, etc. The document indicates that traditional photogravure roll and screen print methods produce patterns of dots that may be too large, while in spraying techniques, the dot size and quantity of product deposited is difficult to control. The document proposes impregnating a textile with a functional composition in the form of dots, wherein a mean dot diameter is 30 to 500 microns and the occupied area ratio thereof is 3 to 95%. Although the document suggests the use of inkjet printing techniques, it identifies conventional inkjet devices as being unsuitable, in particular due to the high viscosity of traditional coating compositions. The document is concerned primarily with maintaining an identifiable droplet structure and preventing the droplets from running together. Furthermore, the document provides examples regarding the use of solutions but fails to address the problems of inkjet deposition of dispersions or suspensions.

Inkjet printers of various types are generally known for providing graphic images. Such printers may be desktop inkjet printers such as used in the office or home and are generally used for printing onto a particular type of paper substrate (printer paper), using small droplets (<20 pL) of water based inks containing colorants. Larger, industrial inkjet printers also exist for printing graphic images or date/batch codes onto products; these printers are typically printing onto non-porous substrates using solvent based inks containing colorants pigments. Such formulations are not however suitable for application to most textiles in particular due to lack of colour fastness. In order to print onto textiles using inkjet techniques, textile articles have in the past been pretreated with a coating onto which ink droplets may be applied. For upgrading purposes, most currently used coatings and finishing compositions are unsuitable for deposition using inkjet techniques. Industrial inkjet printers and nozzles that produce large droplets are generally designed for use with solvent based, coloured inks. Furthermore, the droplet volumes that can be jetted are extremely low, in the order of 50 pL and mostly insufficient for textile finishing, where a significant penetration into the fabric is necessary. Typical finishing formulations are mostly water based and generally have particle sizes that can cause clogging of the nozzles. Additional problems with foaming, spattering and encrustation have been encountered. When working with large numbers of nozzles operating continuously at up to 100 KHz, reliability and fault free operation are of prime importance. While indicating that conventional inkjet devices are unsuitable for applying finishing compositions, JP61-152874 fails to provide teaching regarding how this could be improved.

BRIEF SUMMARY OF THE INVENTION

According to the present invention there is provided a method of producing a textile article having a localised finish comprising: providing a continuous supply of a textile substrate; providing an array of digital nozzles; supplying a finishing composition to the nozzles; and selectively depositing the finishing composition from the nozzles in a series of droplets to deposit a first predetermined pattern of droplets on a selected area of the substrate to endow a functional characteristic on the selected areas. In this way, it is possible to ensure that only those areas receive the finishing composition that ultimately require it. Valuable chemicals and process time can hereby be reduced.

In the present context, the term "finishing" is understood to mean processes that change the functionality of a textile substrate rather than merely providing it with a coloured design or changing its visual appearance as is the case with conventional inkjet printing using inks and dyes. In this context it is understood to encompass both coating and impregnating and also to include other physical treatments that upgrade the functionality of the substrate.

The term "finishing composition" herein encompasses aqueous solutions, aqueous dispersions, organic solutions, organic dispersions, curable liquid mixtures and molten compounds that comprise an active component. According to an important advantage of the invention, the formulation may be non-reactive with the substrate. In this manner, the formulation may be applied to a greater diversity of substrates than would otherwise be the case.

The term "digital nozzle" is intended to refer to a device for emitting a defined droplet from a supply of agent in response to a digital signal and depositing the droplet at a defined and controllable position. The term includes inkjet-printing heads working on both the continuous flow and drop-on-demand principles. It also includes both piezoelectric and thermal inkjet heads and encompasses other equivalent devices such as valve jets, capable of digital droplet deposition. Digital nozzles are generally well known to the skilled person in the field of graphic printing. It is considered that the nozzles of this invention can have an outlet diameter between 10 and 150 microns, preferably around 70 to 90 microns.

Furthermore, the term "textile" is intended to encompass all forms of textile article, including woven textiles, knitted textiles and non-woven textiles. The term is intended to exclude fibrous articles having two-dimensional rigidity such as carpets, paper and cardboard. These fibrous articles, although sometimes referred to as textiles, are internally linked in such a way that they maintain a substantially fixed two-dimensional form. Even though they may be flexible in a third dimension they are not generally free to stretch or distort within the plane of the fibre layer, as is inherent in a true textile. Preferably the textile substrate is more than 100 meters in length and may be provided on a roll or the like having a width of greater than 1 meter. Preferred textiles comprise cotton and/or other treated cellulosic fibres and also polyesters, polyamides, polyacrylnitril and acetates and triacetates or blends thereof.

According to one feature of the present invention, the first predetermined pattern of droplets may comprise a matrix of individual droplets. The individual droplets may be arranged in any appropriate matrix e.g. in a square matrix with the individual droplets either separated or (partially) overlapping. For certain applications, a discontinuous coating may be achieved by depositing droplets with small gaps between adjacent droplets. Such a distribution may be used e.g. in conjunction with an impervious coating to provide breathability, whereby the gaps are large enough to allow passage of vapour but too small to allow water droplets to pass through. For providing individual deposits of e.g. drugs or medication, it may be necessary to provide individual droplets spaced widely on the surface of the substrate, whereby the spacing determines the dosing characteristic of the drug.

A particularly useful manner of depositing a drug or medicinal or biologically active agent on the substrate is by the use of a carrier. Appropriate carriers include cyclodextrines, fullerenes, aza-crown ethers and also polylactic acid (PLA). These carriers are ideally suited for attachment both to the textile fibres and to the agent. A review of these carriers is to be found in an article by Breteler et al. in Autex Research Journal, Vol. 2 No 4 entitled Textile Slow Release Systems with Medical Applications, the contents of which are hereby incorporated by reference in their entirety.

Under certain circumstances, the selected area may comprise substantially the complete surface of the substrate. This may be the case for a matrix of droplets e.g. for a waterproof coating or for dispersion of a medical agent. Under other circumstances, it may be desirable to provide the first pattern of droplets over a restricted area or a plurality of individual areas. In this way, localized areas can be produced having the relevant functional characteristic while the remainder of the substrate has a distinct characteristic. An example of such a functional characteristic could be a deoderising finish for clothing which could be provided only in areas of the substrate which are ultimately confected as the underarm of an item of clothing. Known deoderising finishes utilizing silver are particularly costly and often unsuitable for use in current full-font finishing techniques.

According to an alternative aspect of the present invention, the first predetermined pattern of droplets may comprise a series of droplets interconnected to form a line. The line may e.g. function as an element of an electrical or semi-conductive circuit whereby enhanced functionalities may be provided on the textile substrate. Such enhanced functionalities may include but are not limited to energy conversion, photo-voltaic, imaging, lighting, sensing, anti-static, computing and memory.

According to a feature of the invention, the finishing composition may comprise a metallic substance. In this context, the term metallic substance is understood to cover elemental metals and alloys, in particular such substances that may conduct electricity as being distinct from metal compounds e.g. metal salts. Metallic substances are often relatively expensive, in particular those having enhanced functional characteristics, and are thus particular advantageous for use in the present invention.

According to a further feature of the present invention, the method may additionally comprise providing a finishing device and performing a finishing action on the substrate in a continuous process. In this context, the term finishing device is used only to distinguish from the first array of nozzles which may also perform a finishing function. The finishing device may thus be a further nozzle or array of nozzles, similar or distinct from the first array of nozzles. It may also comprise a cutting device e.g. a laser cutting device, a marking device, a curing device, a drying device or any other similar device suitable for integration with the first array of nozzles to form an inline, continuous treatment of the textile substrate. Furthermore, the term finishing action is not intended to limit this device only to actions subsequent to depositing the first predetermined pattern of droplets. Thus the finishing device may perform the finishing action prior to depositing the first predetermined pattern of droplets.

By operating in a continuous process, a particularly compact method of operation is achieved whereby the substrate is treated in a two-step or multi-step process. Such a continuous process may take place within a single machine without need for intervening transport or storage. This has particular advantages for the accuracy of the relationship between the different steps of the process e.g. between the deposit of the first predetermined pattern of droplets and the performance of the finishing action.

According to one embodiment of the invention, the finishing device comprises a further array of nozzles for depositing a second predetermined pattern of droplets onto the substrate. The second predetermined pattern of droplets may be similar or e.g. overlay the first pattern. Alternatively, the second pattern may be complementary to the first pattern e.g. filling previously unfinished areas or otherwise connecting the selected areas of the first pattern.

In a particularly advantageous embodiment, the first predetermined pattern and the second predetermined pattern are deposited in overlapping relation to produce a relief on the surface of the substrate. In the present context, the term "relief" is intended to mean a variation in thickness or height of the finished substrate surface. In this way, finishes or coatings may be applied or built up to provide greater thickness or more complete coverage in areas where the finish is most required. Less finish e.g. a single layer may be applied in other areas while in the remaining areas no finish need be applied. Such a variation in coating could be used to impart wear resistance to e.g. knee and elbow portions of a pattern.

In a further development of such an embodiment a plurality of arrays of digital nozzles may be provided, arranged in series in the direction of textile supply, the method comprising supplying each nozzle array with a different finishing composition and selectively activating the individual arrays to deposit a series of layers of finishing composition onto the substrate to form a multi-layered functional finish. In this way, complex functionality may be built up in a textile article.

According to a still further embodiment, the finishing device may comprise a cutter and the finishing action may comprise cutting. The cutter may be used to cut the substrate, in particular, it may be used to cut or partially cut the substrate according to a given pattern for subsequent confection. Alternatively, the cutter may be used to cut into the substrate or into an applied coating or finish. In this way also a relief may be produced on the surface of the substrate by removal or partial removal of material. The cutter may be a laser cutter, including other high-energy electromagnetic cutting or ablating devices. Alternatively it may be a jet cutter such as a high-energy liquid or particle jet. The cutter may also be a chemical cutter e.g. providing a caustic product to burn through or into the substrate or finish. In this context, "chemical cutter" is also understood to include etching and equivalent processes.

Although different forms of digital nozzle may be used, preferably, the digital nozzles are of the continuous inkjet (CIJ) type and the finishing composition is deposited by CIJ deposition. In the continuous method, pumps carry a constant flow of agent to one or more very small outlets of the nozzles. One or more jets of agent are ejected through these outlets. Under the influence of an excitation mechanism such a jet breaks up into a constant flow of droplets of the same size. The most used excitator is a piezo-crystal although other forms of excitation or cavitation may be used. From the constant flow of droplets generated only certain droplets are selected for application to the substrate of the textile. For this purpose the droplets are electrically charged or discharged. In CIJ, there are two variations for arranging droplets on the textile; binary CIJ and multi-deflection CIJ. According to the binary deflection method, drops are either charged or uncharged. The charged drops are deflected as they pass through an electric field in the print head. Depending on the configuration of the specific binary CIJ printer, the charged drops may be directed to the substrate whilst the uncharged drops are collect in the print head gutter and re-circulated, or vice versa. According to a more preferred method known as the multi-deflection method, the droplets are applied to the substrate by applying a variable level of charge to them before they pass through a fixed electric field, or conversely by applying a fixed level of charge to the drops before they pass through a variable electric field. The ability to vary the degree of the charge/field interaction on the drops means that the level of deflection they experience (and thus their position on the substrate) can be varied, hence 'multi-deflection'. Uncharged drops are collected by the print head gutter and re-circulated. More specifically this method comprises:

feeding the formulation to the nozzles in almost continuous flows;

breaking up the continuous flows in the nozzles to form respective droplets, whilst simultaneously applying an electric field, as required, to charge the droplets;

applying a second electric field so as to deflect the drops such that they are deposited at suitable positions on the textile article.

In the past for the purpose of graphic printing, nozzles having an outlet diameter of up to 50 microns have been used and the general trend is to increasingly smaller nozzle sizes for improved printing resolution and image quality. For the purpose of deposition of a functional finishing composition nozzle outlets with diameters of greater than 70 microns may be used. In this manner, finishing compositions having larger particle sizes and greater percentages of solids can be deposited. The use of larger nozzles is also preferred as the larger droplets produced from these nozzles lead to greater productivity i.e. a higher flow rate (volume of fluid per second) from each nozzle Furthermore, in the case of CU the size of the droplet formed can be varied by varying the pump pressure or the excitation frequency for a given nozzle size. By suitable electronic control of these parameters, the droplet size may be controlled. Such control may be varied intermittently e.g. during set-up or calibration but may also be varied on a drop-by-drop basis allowing still further control of the droplet pattern. Use of the continuous inkjet method makes it possible to generate between 64,000 and 125,000 droplets per second per jet. This large number of droplets and a number of mutually adjacent heads over the whole width of the cloth results in a relatively high productivity: in view of the high spraying speed, a production speed can moreover be realized in principle of about 20 metres per minute using this technology, and in view of the small volume of the reservoirs associated with the nozzles, a finishing regime may be realized within a very short time. However, it is a requirement of continuous inkjet that the finishing composition used has a conductivity to allow the droplets to be charged so that they can be deflected by the electric field. Accordingly for CIJ, it is preferable that the finishing composition has a conductivity greater than 500 μS/cm.

The nozzles are preferably provided in static arrays, spanning the width of the textile substrate. In this way substantially higher speeds can be achieved for the transport of the textile compared to systems where the nozzles are required to traverse the moving substrate.

In a particularly favourable embodiment, the array of digital nozzles comprises a row of static nozzles, aligned perpendicular to a direction of textile supply. By providing an array of static nozzles spanning the fill width of the textile substrate, greater speeds are achievable than when using scanning type heads. In particular, each nozzle may be oriented to provide multi level drop deflection generally perpendicular to the direction of textile supply. In this way, a single nozzle can provide finish over a substrate width of around 5 mm.

In accordance with a preferred embodiment the individual nozzles may be directed with a central control, formed for instance by a computer. The computer may preferably employ a drop and position visualization system that can be used to establish the optimum printhead operating conditions and verify the quality of the droplet formation and the correct positioning thereof. Suitable control of the transport surface may also be provided, interacting with control of the droplet deposition.

The invention also relates to upgraded textile articles, comprising a substrate having a selectively deposited finishing composition, deposited according to the above mentioned methods in a first predetermined pattern of droplets on a selected area of the substrate to achieve a functional characteristic in the selected areas.

Furthermore, the invention also relates to devices for producing upgraded textile according to the above-mentioned methods. In particular, it relates to devices in which a continuous supply of a textile substrate is transported past an array of digital nozzles supplied with a finishing composition for selectively depositing the finishing composition from the nozzles in a series of droplets to deposit a first predetermined pattern of droplets on a selected area of the substrate to endow a functional characteristic on the selected areas. The device may preferably comprise a transport surface for moving the textile substrate past the array of nozzles, the substrate being retained by the transport surface for movement therewith.

BRIEF DESCRIPTION OF THE DRAWINGS

Further advantages will become evident in the light of the description of the following figures depicting a number of exemplary embodiments of the invention, in which.

DESCRIPTION OF ILLUSTRATIVE EMBODIMENTS

Figure 1:
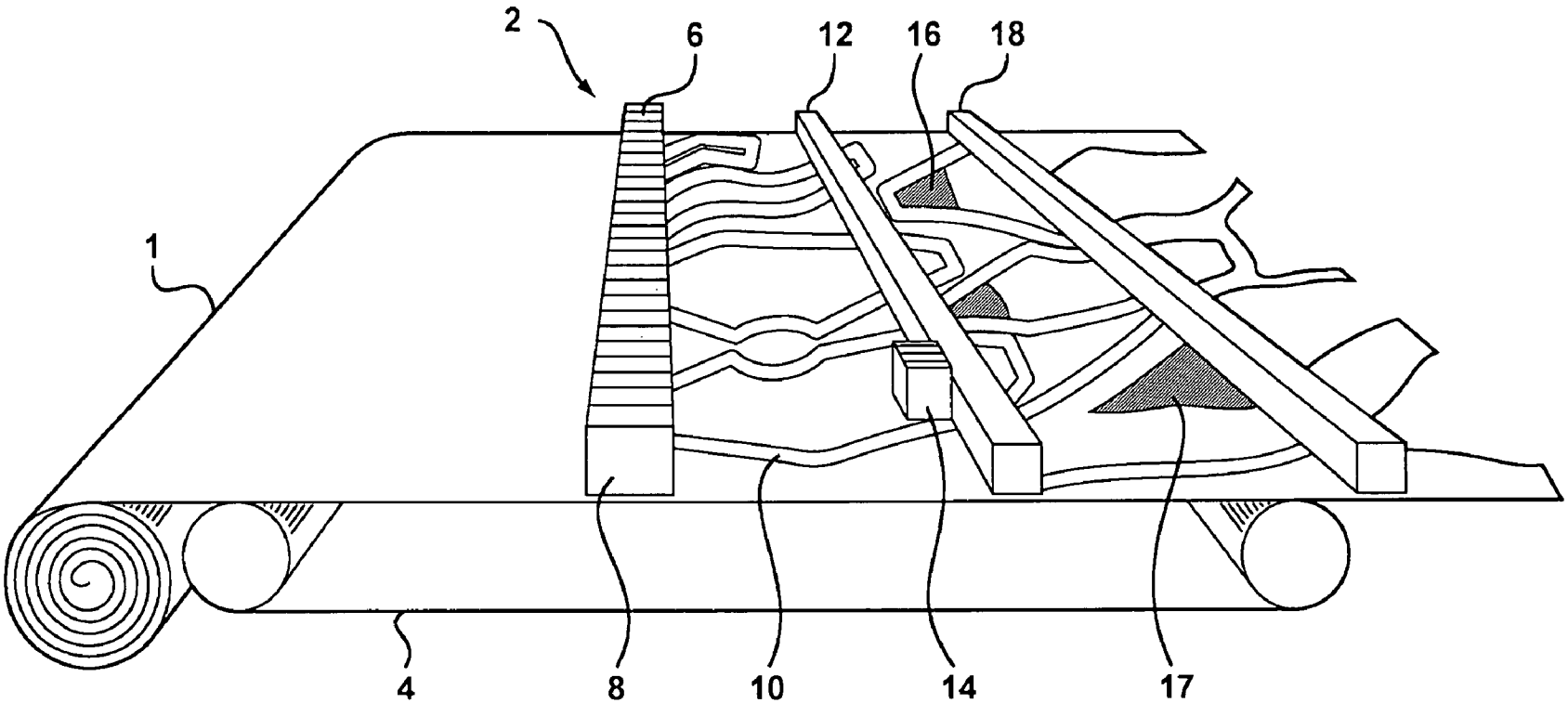
FIG. 1 shows a first example of a digital coating procedure according to the present invention in an in-line confection procedure.

The following is a description of certain embodiments of the invention, given by way of example only and with reference to the drawings. FIG. 1, shows schematically in perspective view a first example of a possible arrangement for providing a digital coating to a textile substrate. According to FIG. 1 there is shown a continuous roll of textile substrate 1 being fed to an upgrading device 2 according to the present invention. The textile substrate 1 is a standard cotton weave of a colour and weight suitable for the confection of men's shirts. The device 2 may be of the type shown in PCT application No PCT/EP2004/010732.

The substrate 1 is carried by conveyor 4 to a first beam 6 on which is arranged an array of 29 inkjet heads 8 of the continuous flow multilevel deflection type. Each inkjet head comprises a number (in this case 8) of individual nozzles (not shown).

The first beam 6 is supplied with an adhesive finishing composition and deposits droplets of the composition onto the textile substrate 1 to form a first pattern 10. In the present example, the pattern 10 represents the outlines of those elements necessary to confect a shirt.

After the first beam 6 is located a second beam 12 also comprising an array of inlet heads 14. The inkjet heads 14 of the second beam 12 are of the drop on demand type and are mounted for transverse movement along the beam 12. The inkjet heads 14 are supplied with a silver based finishing composition for giving a deodorant or anti-bacterial finish to textile. The composition is deposited as a second pattern of droplets onto specific areas of the substrate 1 to form a high density coating 16 in areas that correspond to the underarm region of the finished garment and a low density coating 17 in the middle back and inner elbow regions.

For transport past the first and second beams 6, 12, the substrate 1 is partially affixed to the conveyor 4 to prevent shifting of the textile and ensure exact alignment of the first and second patterns. This may be achieved by e.g. conventional adhesive or vacuum techniques: At the end of the conveyor, the substrate 1 is released at a third beam 18. The third beam 18 comprises a conventional laser-cutter that cuts out the required pattern, which in this case corresponds to the first pattern 10. By combining the coating and cutting operations into a single finishing device, accuracy of cutting with respect to the pattern is ensured.

The elements cut out according to the first pattern 10 have an adhesive coating along their edges. The individual elements of substrate 1 may then be assembled together e.g. by robotic devices to form a finished article. The seams may if necessary be sewn or provided with additional strengthening. Although reference has been made to adhesive, it is clear that any other joining composition that may be applied by digital droplet deposition would also be suitable.

Further nozzle arrays may be provided to apply fibre-conditioning agents, whereby the fibre characteristics are locally changed e.g. to increase elasticity, to elongate, shrink or to make more rigid. In this way, the textile may even be caused to change shape in preparation for joining in a confection process.

Figure 2:
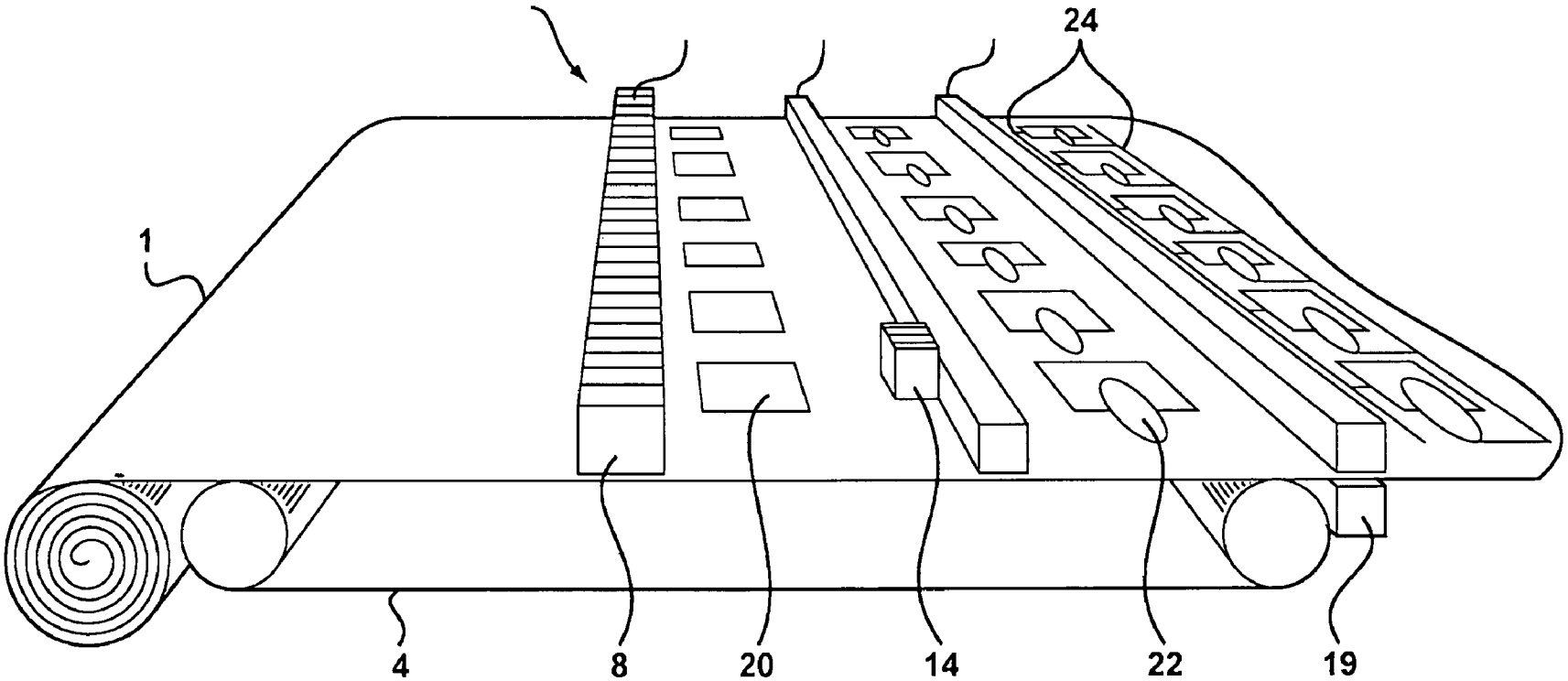
FIG. 2 shows a second example of a digital coating procedure according to the invention for producing an electrical circuit.

According to FIG. 2, there is shown a second exemplary embodiment of the invention in which like elements are designated with the same reference numbers. The second embodiment may be used for producing an electronic circuit on the surface of a textile. According to FIG. 2, the first beam 6 is used to deposit a first pattern of semi-conducting polymer elements 20 onto the substrate. For the sake of clarity the elements are shown at exaggerated scale, it being understood that they may actually be of micrometer scale based e.g. on a single droplet. Second beam 12, deposits a second pattern of semi-conducting polymer elements 22 partially covering the first elements 20. The substrate 1 then passes past the third beam 18 where conducting connections 24 are laid to form an array of functional electronic devices 26. In this embodiment an additional fourth beam 19 may be provided on the opposite surface of the textile to apply the connections from both surfaces. The first or second elements 20, 22 may pass through the textile for this purpose.

While the above is a simplified example of how an electronic device could be deposited, it is evident that the skilled person would be able to build up complicated devices by subsequent deposition of layers to form stacks, including where necessary the (partial) removing of layers by ablation, etching or the like.

Although only certain compositions have been specifically disclosed, the finishing composition may comprise any appropriate agent that can endow a functional property to a textile substrate. In particular it may be selected from the group consisting of anti-static, anti-microbial, anti-viral, anti-fungal, medicinal, anti-pilling, non-crease, flame-retardant, water-repellant, UV-protective, deodorant, wear-resistant, slip-resistant, slip enhancing, grip enhancing, stain-resistant, oil resistant, adhesive, stiffening, softening, elasticity-enhancing, pigment-binding, conducting, semi-conducting, photo-sensitive, photo-voltaic and light-emitting agents.

For use with drugs or medicinal or biologically active agents a carrier may be used and the agent may be jetted at low temperatures e.g. below 40° C. Appropriate carriers include cyclodextrines, fullerenes, aza-crown ethers and also polylactic acid (PLA). These carriers are ideally suited for attachment both to the textile fibres and to the agent. A review of these carriers is to be found in an article by Breteler et al. in Autex Research Journal, Vol. 2 No 4 entitled Textile Slow Release Systems with Medical Applications.

In order for such compositions to be deposited using present inkjet technology, the compositions may be formulated to meet the specifications as defined in Table I below:

TABLE I

Inkjet print head technologies
Coating property requirements

| | Drop on demand (DOD) | | | Continuous (CIJ) | |
|---|---|---|---|---|---|
| Property | Thermal (TIJ) | Piezo | Valvejet | Binary | Multi-deflection |
| Conductivity (uS/cm) | 0 | 0 | 0 | >500 +/− 20%*1 | >500 +/− 20%*1 |
| Salt content Chlorides (ppm) | <10 | <100 | <100 | <100 | <100 |
| Viscosity (cP)@ operating temp. | 1-4 +/− 0.25*2 | 2-15 +/− 0.25-0.5*2 | 2-20 | 1-2.5 +/− 0.25*2 | 2-4 +/− 0.5*2 |
| Surface tension (dynes/cm) | 30-50 | 25-45 | 25-50 | 20-50 | 20-50 |
| Particle size limit (um) | 0.5 | 1 | 5 | 0.5 | 2 |
| pH | 4-10 | 4-10*3 | 4-10 | 4-10 | 4-10 |
| % solids (residual) | <4 | <20*4 | <20 | <4 | <15 |
| Stable to shear rate of (s−1) | $10^5$ | $10^5$ | $10^5$ | $10^6$ | $10^6$ |
| Dot diameter (um) | 20-250 | 20-250 | 100-5000 | 50-300 | 100-2000 |
| Droplet volume (pL) | 2-200 | 2-200 | 150-100,000 | 50-250 | 50-750 |
| Droplet velocity (m/s) | 15 | 5-10 | 10 | 20 | 20 |
| Firing frequency (kHz) | 30 | 30 | <2 | 64-1000 | |

*1tolerance during operation (re-circulation of ink)
*2typical ink manufacturing batch to batch tolerance
*3unless using a ceramic print head, in which case pH 1-14 may be used
*4except in the case of UV curing ink which may be up to 100% solids General Information on the Properties Specified:

Conductivity: this is required in CIJ techniques to allow charging of the droplets, so that they can then be deflected for printing, using an electric field. For all other inkjet techniques conductivity is undesirable as it encourages corrosion of metal components in contact with the ink.

Salt content: this is linked with the above comments on conductivity; some specific salts such as chlorides are particularly undesirable as they are more corrosive than other salts. The salts used in CIJ formulations should be selected to give the desired level of conductivity whilst minimising their corrosion promoting effects. Furthermore, in TIJ formulations, multi-valent metal salts (such as Mg2+ and Ca2+) should be avoided as they promote kogation (crusting of the print head heater element) and will lead to premature failure of the print head.

Viscosity: relative to most dispensing techniques, inkjet requires low viscosity fluids. Often the print head will be heated to reduce the viscosity of a fluid and allow it to be inkjet printed (this also reduces the effect of changes in ambient temperature on printing reliability). Newtonian fluids are preferred for inkjet deposition; however shear thinning fluids may be used with care. Shear thickening fluids should be avoided. Achieving the desired viscosity for a fluid does not guarantee inkjet printing success as other aspects of the fluid's flow properties are also important to the inkjet printing process, such as elasticity and can prevent reliable jetting of a fluid that appears to have the correct viscosity.

Surface tension: broadly speaking controls the wetting of the fluid inside the print head. If the surface tension is too high, the fluid will not wet the internals of the print head properly and will leave air pockets, which will prevent reliable printing. If the surface tension of the fluid is too low, the meniscus will not form properly in the print head nozzle and in the case of DoD, fluid will spontaneously flow onto the print head faceplate (known as faceplate wetting) which will also prevent reliable jetting. In the case of CIJ, droplet break-up will be unreliable.

Particle size: inkjet nozzles are very small (typically of the order of 20-75 microns) and so the maximum particle size of the fluid that can be printed is limited to prevent blocking of the print head nozzles. The maximum particle size allowable is substantially smaller than that of the nozzle as crowding effects can occur when a number of particles attempt to flow through the nozzle at the same time and cause a blockage by jamming against one another. For this reason, the maximum particle size allowable is also to some extent linked with the concentration of particles used.

pH: is typically used to control solubility (or dispersion stability) of active components of the fluid. The pH range that the print head can operate within is limited by corrosion of the materials that it is constructed from. For piezo DOD, ceramic print heads are available, which allow fluids across the full range of pH to be reliably jetted.

% solids: the solids content of the fluid is limited by viscosity (and elasticity) as well as particle size, as described previously. However, if the solids content of the fluid is too high then it can also over damp the pressure pulse used to eject (or break up) the inkjet drop and prevent reliable printing.

Stability to shear: inkjet printing is a high shear technique and so material that is not stable to high shear may decompose in the print head nozzle, blocking it (or the return gutter for a CU system) and also may cease to provide the desired application or end user properties on the substrate. For CU, the shear experienced is in the nozzle is greater than by the other inkjet techniques and also the fluid is re-circulated and so may pass through the nozzle many times, therefore shear stability is of increased importance for this technique.

To achieve these characteristics, preferably the finishing composition comprises the components as defined in Table II below.

For most cases, the solvent or vehicle is preferably de-ionized, de-mineralized water as this provides the best chemical basis for interaction of the active agent with the textile. Alternative finishing compositions using non-water based solvents such as ethanol or lactates may also be employed where the desired characteristics are appropriate or so require. This may be the case where a second layer is to be laid over a water based composition where compatibility with the underlying layer is undesirable, where fast drying is required or where the active agent react with water. In particular lactates are believed to be very good at penetrating cellulosic textiles.

Co-solvent may often be required to improve the solubility of the active component(s) and its compatibility with the conductivity agent (as incompatibility between these materials is a common formulation issue). Typically the co-solvents are low boiling point liquids that can evaporate from the surface of the substrate after acting as the carrier of the active component. It is preferable to use a co-solvent selected from the group consisting of ethanol, methanol and 2-propanol.

TABLE II

| Finishing Composition Compositions defined by % By weight | | | | |
|---|---|---|---|---|
| | Binary CIJ | Multideflection CIJ | Thermal Inkjet (TIJ) | Piezo DOD |
| Solvent | 70-95 | 50-90 | 70-95 | 60-90 |
| Co-solvent | 0 | 0-20 | 0-3 | 0-5 |
| Humectant | 0-3 | 0-5 | 10-30 | 10-35 |

TABLE II-continued

| Finishing Composition Compositions defined by % By weight | | | | |
|---|---|---|---|---|
| | Binary CIJ | Multideflection CIJ | Thermal Inkjet (TIJ) | Piezo DOD |
| Viscosity control agent | 0-2 | 0-25 | | 0-25 |
| Conductivity agent | 0-0.5 | 0-0.5 | | |
| Surfactant | 0-0.5 | 0-0.5 | | |
| Biocide | 0-0.5 | 0-0.5 | 0-0.5 | 0-0.5 |
| pH modifier | 0-1 | 0-1 | 0-1 | 0-1 |
| Corrosion inhibitor | 0-0.2 | 0-0.2 | 0-0.2 | 0-0.2 |
| Wetting Agent | 0 | | 0.01-0.3 | 0.01-0.3 |
| Active agent(s) | 5-20 | 5-30 | 1-5 | 5-30 |

Humectant is usually a low volatility, high boiling point liquid that is used to prevent crusting of the nozzle when the jet(s) are not active. Preferably the humectants are selected from the group consisting of polyhydric alcohols, glycols, especially polyethylene glycol (PEG), glycerol, n-methyl pyrrolidone (NP). Although with certain formulations it may appear that more than 5% humectant is being used, it is in fact the case that the same material may also be present as a viscosity modifier.

Viscosity control agent is the key ingredient for inkjet printing reliability and quality as it controls the droplet formation and break up process—often this material is also an 'active component' and provides some of the end user properties. Generally, high molecular weight polymers in solution should be avoided as their elasticity makes achieving jet break up difficult. Preferred viscosity control agents include polyvinylpyrrolidone PVP), polyethylene oxide, polyethylene glycol (PEG), polypropylene glycol, acrylics, styrene acrylics, polyethyleneimine (PEI), polyacrylic acid (PAA). K-30 weight grade PVP has been found particularly useful due to its low bacterial sensitivity and its non-ionic nature.

Conductivity is required for CIJ to allow the droplets to be charged and therefore deflected and conductivity agents are used when insufficient conductivity is naturally present in the ink. Conductivity agents must be selected that are compatible with the other components of the formulation and do not promote corrosion. Known conductivity agents suitable in this regard include lithium nitrate, potassium thiocyanate, dimethylamine hydrochloride, thiophene-based materials, for example polythiophene or thiophene copolymers including 3,4-ethylenedioxythiophene (EDT) and polyethylenethiophenes. Potassium thiocyanate has been found particularly useful for jetting purposes as relatively little is required to achieve the desired conductivity.

Surfactants are typically included either to reduce foaming of the formulation and release dissolved gases or to lower the surface tension of the droplet and thereby improve wetting. Preferable surfactants for the flame retardent finishing formulation of the present invention include Surfynol DF75™, Surfynol 104E™ Dynol 604 ™ (all available from Air Products) and Zonyl FSA™ (available from Du Pont). BYK 022™ (available from BYK-Chemie) and Respumit S™ (available from Bayer) are both silicone based antifoam agents that have proved very effective for jetting purposes.

Wetting agents are utilized to improve the surface wetting of the fluid on the internal capillaries of the digital nozzle. Preferred wetting agents include acetylinic diols. Surfactants and co-solvents may also function as wetting agents.

Biocide is used to prevent bacteria growing in the formulation—often this is not required if other components of the formulation (such as IPA) are sufficiently concentrated to kill bacteria.

pH modifiers are used to maintain a pH at which the solids of the formulation are soluble (or stably dispersed), typically this is pH>7, so most are alkaline. The pH modifier may also be used to affect the chemistry of the interaction between the composition/active agent and the textile itself. Ammonia, morpholine, diethanolamine, triethanolamine and acetic acid are suitable pH modifiers. Generally, it is desirable from an inkjet perspective to use relatively neutral solutions to reduce corrosion in the print heads.

Corrosion inhibitor is used to prevent unwanted ions present in the fluid (usually as impurities coming from the active components) from causing corrosion of the printer.

Under certain circumstances, UV cure resins may also be desirable, particularly where a highly durable finish is desired. Such resins may be appropriate e.g. for the encapsulation of a previously deposited droplet.

EXAMPLE

A formulation according to Table III containing an active flame retardant component was prepared. It should be noted that although the flame retardant agent Flammentin KRE™ is present at 70 wt %, it is in a 40% aqueous solution. The overall concentration of functional agent is therefore 28 wt %.

The formulation was found to have the physical properties according to Table IV

The formulation Man 41*f* was deposited onto 280 gsm Cotton BD using a Domino JetArray™ inkjet printer. Printing a drop volume of 1300 pL at a cross web resolution of 54 dpi and a down web resolution of 369 dpi achieved the desired active functional coat weight (for this fabric weight) of 11.2 gsm

TABLE III

| Formulation Man 41f | Function | Percentage By Weight (%) |
|---|---|---|
| Deionised water | Medium | 18.83 |
| Respumit S (10% in DI water) | Antifoam | 0.02 |
| Polyethylene glycol 200 | Humectant | 10.00 |
| Nuosept 491 (10% in DI water) | Biocide | 1.00 |
| Zonyl FSA (10% in DI water) | Surfactant | 0.15 |
| Flammentin KRE (40% solids) | Flame Retardant | 70.00 |

TABLE IV

| Man 41f Properties | |
|---|---|
| Viscosity (cP at 25° C.) | 3.57 |
| pH | 5.27 |
| Surface tension (dynes/cm) | 35.5 |
| Filtration (um) | 6.0 |
| Solids (%) | 28.0 |
| Conductivity (mS/cm) | 25.5 |

The increased functional material concentration allows the desired level of flame retardency to be deposited from a smaller number of droplets, which increases the line speed of the system and significantly reduces the amount of water used and therefore the drying power requirement. By depositing the formulation only onto those areas of the substrate subsequently used in a product, substantial reduction in formulation usage can be achieved.

While the above examples illustrate preferred embodiments of the present invention it is noted that various other arrangements may also be considered which fall within the spirit and scope of the present invention as defined by the appended claims.

What is claimed is:

1. A method of producing a textile article having a functional finish, comprising:

providing a substantially continuous supply of a textile substrate;

providing a first array of digital nozzles;

providing a second array of digital nozzles;

supplying finishing compositions to the nozzles;

selectively depositing finishing composition from the first array of digital nozzles in a series of droplets to deposit a first predetermined pattern of droplets on one or more selected areas of the substrate to endow a functional characteristic on the selected areas, the selected area comprising less than the complete surface of the substrate; and depositing a further series of droplets of finishing composition onto the substrate from the second array of digital nozzles in a second predetermined pattern complementary to the first pattern such that the second pattern fills previously unfinished areas of the first pattern or otherwise connects the selected areas of the first pattern.

2. The method according to claim 1, wherein the first predetermined pattern of droplets comprises a matrix of individual droplets.

3. The method according to claim 1, wherein the selected area comprises a plurality of individual areas.

4. The method according to claim 1, wherein the first predetermined pattern of droplets comprises a series of droplets interconnected to form a line.

5. The method according to claim 1, wherein the finishing composition comprises a metallic substance.

6. The method according to claim 1, wherein the finishing composition is selected from the group consisting of anti-static, anti-microbial, anti-viral, anti-fungal, medicinal, non-crease, flame-retardant, water-repellant, UV-protective, deodorant, wear-resistant, stain-resistant, adhesive, stiffening, softening, elasticity-enhancing, pigment-binding, conducting, semi-conducting, photo-sensitive, photo-voltaic, and light-emitting agents.

7. The method according to claim 1, further comprising providing a finishing device and performing a finishing action on the substrate in a continuous process.

8. The method according to claim 7, wherein providing a finishing device comprises providing a cutter and the finishing action comprises cutting the substrate according to a given pattern.

9. The method according to claim 8 wherein the cutter is selected from the group consisting of laser cutters, jet cutters, chemical cutters and thermal cutters.

10. The method according to claim 1, wherein the step of providing an array of digital nozzles comprises providing digital nozzles of the continuous flow inkjet type, and the step of selectively depositing the finishing composition comprises depositing the finishing composition by continuous flow jet deposition.

11. The method according to claim 10, wherein the step of providing an array of digital nozzles comprises providing digital nozzles of the multi-level deflection type, and the step of selectively depositing the finishing composition comprises depositing droplets by applying a charge to the droplets and directing them onto the substrate using a varying electric field.

12. The method according to claim 10, wherein the step of providing an array of digital nozzles comprises providing a row of static nozzles of the multi-level deflection type, aligned generally perpendicular to a direction of textile supply, the method comprising selectively deflecting droplets from the nozzles in a plane generally perpendicular to the direction of textile supply.

13. The method according to claim 1, wherein a plurality of arrays of digital nozzles is provided, arranged in series in the direction of textile supply, the method comprising supplying each nozzle array with a different finishing composition and selectively activating the individual arrays to deposit a series of layers of finishing composition onto the substrate to form a multilayered functional finish.

14. The method according to claim 1, further comprising providing a transport surface for moving the textile substrate past the array of nozzles and retaining the substrate by the transport surface for movement therewith.

* * * * *